United States Patent [19]

Fujimoto et al.

[11] 4,152,027

[45] May 1, 1979

[54] SHIELD TYPE HYDRAULIC TUNNEL BORING MACHINE

[75] Inventors: Kenichi Fujimoto; Kunitaka Saito; Masaharu Saito, all of Tokyo, Japan

[73] Assignee: Tekken Construction Co. Ltd., Tokyo, Japan

[21] Appl. No.: 868,533

[22] Filed: Jan. 11, 1978

[30] Foreign Application Priority Data

Apr. 28, 1977 [JP] Japan ..... 52-48374

[51] Int. Cl.[2] ..... E21D 9/00

[52] U.S. Cl. ..... 299/1; 33/170; 33/178 E; 33/178 F; 33/166; 405/141

[58] Field of Search ..... 299/1; 33/170, 178 E, 33/178 F, 166, 1 H; 61/84

[56] References Cited

U.S. PATENT DOCUMENTS

| | | | |
|---|---|---|---|
| 428,021 | 5/1890 | Rothwell | 175/86 |
| 2,927,377 | 3/1960 | McMahan | 33/178 F |
| 3,585,727 | 6/1971 | Hirose | 33/178 |
| 3,844,097 | 10/1974 | Carson | 33/166 |
| 4,040,666 | 8/1977 | Uchida | 299/1 |

*Primary Examiner*—William Pate, III

*Attorney, Agent, or Firm*—Burns, Doane, Swecker & Mathis

[57] ABSTRACT

A shield type hydraulic tunnel boring machine having means for detecting an occurrence of excess excavation due to accidental collapse in tunnel face ground apt to occur during tunnel boring through soft and unstable ground and for further determining the location, shape, scale and the like of such excess excavation occurred is provided. The means comprises optimumly a plurality of rod-shaped members capable of being extended out of and retracted into the machine. Amounts by which these members are paid out until they reach ground wall of any cavity due to the occurred excess excavation are measured to determine the actual state of such cavity. The means is provided preferably at a plurality of proper positions on a shield body of the machine and respective values of the measured amounts at these positions are recorded and displayed, whereby the location, shape, scale and the like of the occurred excess excavation can be confirmed.

16 Claims, 3 Drawing Figures

SHIELD TYPE HYDRAULIC TUNNEL BORING MACHINE

FIELD OF THE INVENTION

This invention relates in general to shield type tunnel boring machines and, more particularly, to improvements in shield type hydraulic tunnel boring machines which are capable of accurately detecting occurrences, shapes, scales and the like of any excess excavation due to accidental tunnel face collapses of soft and unstable ground.

BACKGROUND OF THE INVENTION

Hitherto, in shield tunnel boring machines for boring tunnels through soft and unstable ground in which a inner space of the shield body is partitioned by a bulkhead at a position behind a rotary cutter head on the forward end of the shield body for boring the tunnel face, it has been practically impossible to directly observe or accurately reliably realize the actual state of any accidental collapses of tunnel face ground in excess of the actual amount being excavated (which shall be referred to as "excess excavation" hereinafter). Such collapses frequently occur during the tunnel boring operation through soft and unstable ground. Specifically in the case of the hydraulic type boring machines utilizing generally muddy water as a liquid for hydraulic boring of the ground, such muddy water is completely opaque when excavated ground formations are mixed therewith so that direct observation of the tunnel face state can never be achieved even if an observing window is provided in the bulkhead. For this reason, there have been suggested certain measures of determining the occurrence of the excess excavation based on rapid change or increase in excavated ground formations which are drained out of the tunnel face together with the muddy water fed to the face. However, even with these measures, still it has been impossible to promptly determine the occurrence of the excess excavation since the measurements of the amount of drained ground formation involve an inherent time lag due to existing distance between the tunnel face and actual measuring position of the drained ground formation amount. Moreover, it is practically impossible to detect or measure the location, shape and the like of the excess excavation only by measuring the varying amount of the drained ground formations.

SUMMARY OF THE INVENTION

A primary object of the present invention is, therefore, to provide a shield type hydraulic tunnel boring machine which is capable of promptly detecting an occurrence of the excess excavation without substantial delay.

Another object of the present invention is to provide a shield type hydraulic tunnel boring machine capable of measuring accurately the location, shape and scale of the excess excavation as soon as it occurs during the tunnel boring work.

A further object of the present invention is to provide a shield type hydraulic tunnel boring machine that allows a continuous monitoring of the actual state of the tunnel face ground to be performed during the boring operation so that any occurrence of the excess excavation can be immediately detected as well as its actual location, shape and scale whereby the boring operation can be continued while performing proper measures against such detected excess excavation.

BRIEF DESCRIPTION OF THE DRAWINGS

Other objects and advantages of the present invention shall be made clear from the following description of preferred embodiments of the invention with reference to the accompanying drawings, in which.

DETAILED DESCRIPTION OF THE INVENTION

Figure 1:
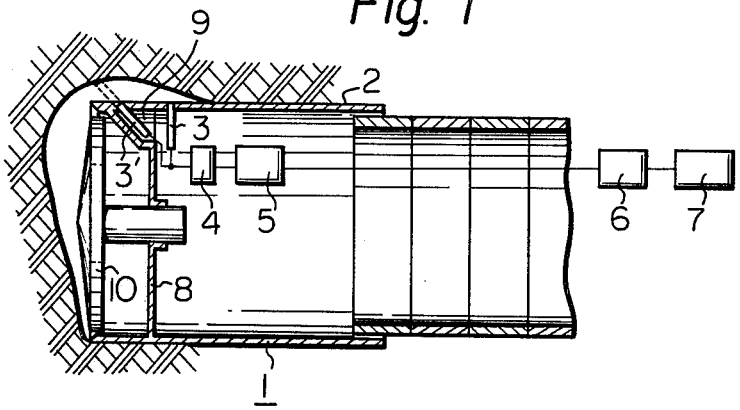
FIG. 1 is a schematic vertical section of an embodiment of the shield type hydraulic tunnel boring machine in use according to the present invention.

Referring to FIG. 1, there is shown an embodiment of the present invention, in which a shield type tunnel boring machine 1 comprises a substantially cylindrical shield body 2. An axial end of the body 2 is partitioned by a bulkhead 8 forming a boring head of the machine and carrying centrally therein a rotary shaft of a substantially disk-shaped rotary cutter head 10 driven by a proper driving means not shown but generally installed behind the bulkhead. While not specifically shown here for the purpose of simplicity, the machine is also provided with a hydraulic medium feeding pipe opened at the axial end of the shield body behind the cutter head 10 and a medium and formation mixture draining pipe likewise opened behind the cutter head. This enables a hydraulic medium under pressure for resisting tunnel face ground or underground water pressure to be fed to the boring head and tunnel face while the cutter head is rotated to cut and bore the ground. A mixture of the medium and excavated ground formations will be drained out of the boring head and tunnel being bored. The machine is advanced toward the tunnel face depending on the amount of excavation by means of jacks or the like and reinforcing segments are installed behind the advanced machine.

According to this embodiment, there are provided in the shield body 2 a through hole in an area adjacent the boring head, preferably at a plurality of positions on the upper side of the body as spaced from one another. An excess excavation detecting means 3 is provided having a movable member which can be extended and retracted through the through hole in the upward direction. Since the excess excavation occurs mainly in the upper part of the tunnel face, it is important to detect such occurrence in the upper part of the tunnel face for maintaining both the tunnel being bored and environmental ground stable. The extended distance of the movable member of the detecting means 3 until it reaches the tunnel face ground wall or ground surface of a cavity caused by the excess excavation is measured by a measuring means 4, preferably electrically. This measured value is delivered preferably to a recorder 7 through a synchronous signal transmitter 5 and a synchronous signal receiver 6, so that a presence or absence, position, shape, scale and the like of the excess excavation will be determined.

Conveniently, the detecting means 3 is disposed at a position of the shield body 2 immediately behind the bulkhead 8. However, in order to perform the detection with respect to a region on the upper side of the forward end of the shield body, it is preferable to provide a recessed chamber 9 in the hydraulic chamber defined by the bulkhead 8 behind the cutter head 10 and communicated with working space inside the shield body and to dispose in this chamber 9 a detecting means 3' so as to extend its movable member in diagonally upward direction.

Figure 2:
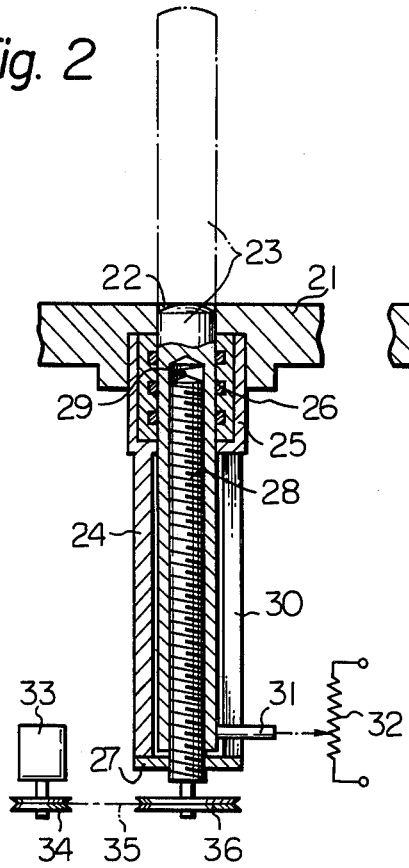
FIG. 2 is a vertically sectioned view of an embodiment of an excess excavation detecting and measuring means employed in the machine according to the present invention of FIG. 1.

A practical example of the detecting means 3 or 3' in the above embodiment is shown in FIG. 2, in which a skin-plate 21 of the shield body is provided with a through hole 22 at the position adjacent the bulkhead. A detecting rod 23 is disposed in the hole 22 so as to be extended out of the shield body and retracted into the same. The rod 23 shown with the solid line is in its position retracted and a chain line shows its extended state, in the drawing. Around the rod 23 in the retracted position, a tubular member 24 is mounted to the inner surface of the skin-plate 21 so as to enclose the rod 23 therein. Inside the tubular member 24, a partition 25 is formed at a position close to the skin-plate and a water-tight packing 26 is housed between the partition 25 and the skin-plate 21 so that, when the detecting rod 23 is extruded and retracted, any underground water outside the shield body will be prevented from entering into the shield body through the hole 22. At the bottom of the tubular member 24, a bottom plate 27 having a central hole is secured. A threaded rod 28 is passed through the hole so as to be movable along the axial line of the rod. This threaded rod 28 is screwed into a threaded hole 29 in the detecting rod 23 along its axial line. Further in the tubular member 24, there is provided an axially extending slot 30, through which an actuating lever 31 projects. This lever 31 is fixed at one end to the detecting rod 23 for actuating at the other end a potentiometer 32. The threaded rod 28 has at its end extended out of the bottom plate 27 a pulley 36 fixed thereto, so that the rod 28 will be rotated about its axis by a motor 33 through a belt 35 hung between the pulley 36 and a drive shaft pulley 34 of the motor 33.

Referring to the operation of the excess excavation detecting means with reference to the embodiment of FIG. 2 according to the present invention, the motor 33 is rotated preferably at scheduled time periods, whereby the threaded rod 28 is axially rotated. Depending on the direction of the rotation, the detecting rod 23 is caused to axially shift so as to be extended out of the shield body until its outer end abuts the ground wall surface surrounding the shield body and its boring head. Accompanying such shift of the rod 23, the actuating lever 31 also shifts so that the lever will actuate a movable element of the potentiometer 32 in response to the amount of the shift of the lever 31. It is thus possible to periodically measure the shifting distance of the actuating lever 31 as well as the detecting rod 23 by means of variations in the electric resistance value of the potentiometer 32. In this manner distances between the periphery of the shield body and the ground wall surface can be determined and, if the distance value becomes large, it means that an excess excavation has occurred. Accordingly, if a plurality of the detecting means are disposed so as to be spaced along the axial line of the shield body and, optimumly, further along a line intersecting the axial line of the shield body, the shape, scale and the like of any cavity resulting from the excess excavation can be precisely determined depending on the distribution of the detecting means and their measured distances.

For the motor 33, it is preferable to employ one which stops or reverses its rotation in response to an increment of load sensed through the detecting rod. Upon the reversed rotation of the motor or the threaded rod 28, the detecting rod 23 is retracted into the tubular member 24.

Figure 3:
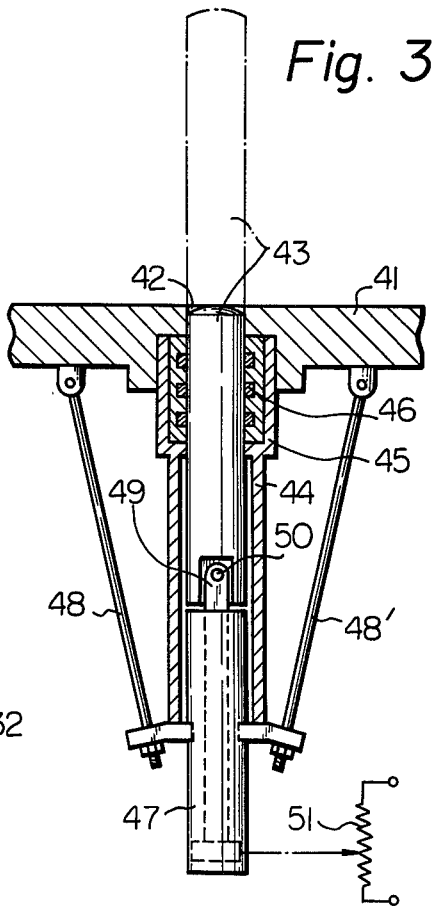
FIG. 3 is a vertically sectioned view of another embodiment of the excess excavation detecting and measuring means of the present invention.

Another practical example of the detecting means is shown in FIG. 3, in which a through hole 42 is made in a skin-plate 41 of the shield body and a detecting rod 43 is disposed in the hole 42 so as to be extended and retracted therethrough. A tubular member 44 is secured at an axial end to the inner surface of the skin-plate 41 so as to axially enclose therein the rod 43. The tubular member 44 has a partition 45 at a position adjacent the inner surface of the skin-plate and, between this partition 45 and the skin-plate 41, a water-tight packing means 46 is accommodated around the rod 43 so as to prevent any underground water or the like from entering into the shield body when the detecting rod 43 is extended and retracted. On the side of the other end of the tubular member 44, there is provided, for example, an oil pressure jack 47 which is controllably driven electrically through a differential transformer. This jack 47 is supported in the position preferably by means of a pair of supporting rods 48 and 48' secured to the skin-plate. A plunger 49 of the jack 47 is coupled to an inner end of the detecting rod 43 by means of a pivot pin 50. The plunger 49 of the jack, or its piston, is connected through any proper means to a movable contact of an electric variable resistance member 51 forming a potentiometer so that electric resistance of the member 51 will vary in response to shifting positions or amounts of the detecting rod 43 due to operations of the jack 47. In this manner, the extended amount of the rod 43 is determined in view of the variations in the electric resistance of the resistance member 51. The operation of the jack 47 is performed by varying the oil pressure inside the cylinder thereof.

In the case of the embodiment of FIG. 1, it is also possible to determine or measure the height of the excess excavation cavity caused above the shield body or the boring head by converting the measured distance of the diagonally extruded detecting means 3' on the basis of the diagonal angle of the means with respect to the axis of the shield body.

According to the present invention, as has been described, the occurrence of the excess excavation in the tunnel face ground being bored can be promptly detected without substantial delay, even though the tunnel boring work has to be performed in blinding conditions for operators of the boring machine with respect to the state of the ground, since the machine is provided with such detecting means as described. Since the measurements of such detecting means can be utilized even for visually indicating the shape, scale, location and so on of the occurred excess excavation, the operators can realize the state of the excess excavation immediately so that any proper measure against the occurred excess excavation can be promptly taken. As the measurements can be further utilized as signals for controlling the hydraulic tunnel boring system in response to the detected state of any excess excavation in the tunnel face ground, the system can be operated automatically while continuously watching the state of the tunnel face ground being bored and performing any proper measure againt the excess excavation.

While the invention has been referred to principally with reference to the embodiments illustrated, it should be appreciated that the intention is not to limit the invention to the particular embodiments but is to rather include all alterations, modifications and equivalent arrangements possible within the scope of appended claims.

For example, in the respective embodiments, the detecting means may be of a type that can be rotated about a pivot on the skin-plate as the center so as to be extended out of the shield body by a properly associated and disposed driving means. In this manner the distance from the shield body to the cavity wall due to the excess excavation will be determined from the rotating angle of such rotated detecting means which is rotated until it reaches the cavity wall. Further, the driving of the detecting rod by means of the axial rotations of the threaded rod in mesh with the threaded axial hole in the detecting rod may be achieved by a worm gear in engagement with peripheral threads on the detecting rod. In this case, the maximum extended amount of such detecting rod will not be limited to an engaging distance of the rod with the threaded rod so that a longer extension or shifting amount can be obtained. However, it should be appreciated that the illustrated embodiments have been suggested as the most advantageous ones in respect of the structure, the manner in which the shifting amount of the detecting means is detected and so on.

It should be also appreciated that the shifting amount of the detecting rod should not be necessarily "larger" so as to be most advantageous, but it is likewise advantageous to properly repeat the detecting operations even with a smaller shifting amount or to provide a proper number of the detecting rods at a proper number of positions on the machine so that the occurrence and actual state of the excess excavation can be determined at an earlier stage of such occurrence.

What is claimed is:

1. A shield type hydraulic tunnel boring machine comprising a substantially cylindrical shield body having a bulkhead for closing an axial forward end of said shield body, a rotary cutter head including a rotary shaft carried by said bulkhead to be rotated at said forward end in front of the bulkhead for hydraulically cutting and boring tunnel face ground, said shield body including a hole, an extensible-retractible detecting rod mounted in said shield body for extension outwardly thereof through said hole along the longitudinal axis of said rod for detecting any circumferential cavity due to an excess excavation, water tight sealing means disposed to provide a water tight seal around said detecting rod, said rod including a threaded hole extending longitudinally therein, a threaded driving rod engaged in said threaded hole, means for rotating said driving rod in either direction to extend or retract said detecting rod, and means for measuring the extended amount of the detecting rod.

2. A machine according to claim 1 wherein said detecting rod is disposed on the upper side of said shield body and adjacent said axial forward end of the body.

3. A machine according to claim 1 wherein a plurality of said detecting rods are provided in spaced relation on the upper side of said shield body and adjacent said axial forward end of the body.

4. A machine according to claim 1 wherein said detecting rod is extended and retracted in a direction substantially at right angles with respect to the longitudinal axial line of said cylindrical shield body.

5. A machine according to claim 1 wherein said detecting rod is extended and retracted in a diagonally forward direction with respect to the longitudinal axial line of said cylindrical shield body.

6. A machine according to claim 3 wherein said plurality of detecting rods include a detecting rod whose longitudinal axis is disposed substantially in a direction at right angles with respect to the longitudinal axial line of the shield body and a detecting rod whose longitudinal axis is disposed in a diagonally forward direction with respect to the longitudinal axial line of the shield body.

7. A machine according to claim 1, wherein said measuring means is provided with means connected thereto for recording and displaying measured values of the detecting rod.

8. A machine according to claim 1, wherein said measuring means comprises an electric resistance member, said detecting rod being operatively connected to said resistance member to vary the electric resistance values thereof in relation to the amount of extension of the detecting rod.

9. A shield type hydraulic tunnel boring machine comprising a substantially cylindrical shield body having a bulkhead for closing an axial forward end of said shield body, a rotary cutter head including a rotary shaft carried by said bulkhead to be rotated at said forward end in front of the bulkhead for hydraulically cutting and boring tunnel face ground, said shield body including a hole, an extensible-retractible detecting rod mounted in said shield body for extension outwardly thereof through said hole along the longitudinal axis of said rod for detecting any circumferential cavity due to an excess excavation, water tight sealing means disposed to provide a water tight seal around said detecting rod, a fluid jack including a plunger connected to an inner end of the rod for selectively extending or retracting the rod, and means for measuring the extended amount of the detecting means.

10. A machine according to claim 9 wherein said detecting rod is disposed on the upper side of said shield body and adjacent said axial forward end of the body.

11. A machine according to claim 9 wherein a plurality of said detecting rods are provided in spaced relation on the upper side of said shield body and adjacent said axial forward end of the body.

12. A machine according to claim 9 wherein said detecting rod is extended and retracted in a direction substantially at right angles with respect to the longitudinal axial line of said cylindrical shield body.

13. A machine according to claim 9 wherein said detecting rod is extended and retracted in a diagonally forward direction with respect to the longitudinal axial line of said cylindrical shield body.

14. A machine according to claim 11 wherein said plurality of detecting rods include a detecting rod whose longitudinal axis is disposed substantially in a direction at right angles with respect to the longitudinal axial line of the shield body and a detecting rod whose longitudinal axis is disposed in a diagonally forward direction with respect to the longitudinal axial line of the shield body.

15. A machine according to claim 9 wherein said measuring means is provided with means connected thereto for recording and displaying measured values of the detecting rod.

16. A machine according to claim 9, wherein said measuring means comprise an electric resistance member, said detecting rod being operatively connected to said resistance member to vary the electric resistance values thereof in relation to the amount of extension of the detecting rod.

* * * * *